US007910852B2

(12) United States Patent
Chen et al.

(10) Patent No.: US 7,910,852 B2
(45) Date of Patent: Mar. 22, 2011

(54) ENCAPSULATED POLE UNIT CONDUCTOR ASSEMBLY FOR AN ENCAPSULATED POLE UNIT AND MEDIUM VOLTAGE CIRCUIT INTERRUPTER INCLUDING THE SAME

(75) Inventors: Steven Z. Chen, Moon Township, PA (US); James J. Benke, Pittsburgh, PA (US); Zachary R. Jenkins, Pittsburgh, PA (US); Xin Zhou, Franklin Park, PA (US)

(73) Assignee: Eaton Corporation, Cleveland, OH (US)

( * ) Notice: Subject to any disclaimer, the term of this patent is extended or adjusted under 35 U.S.C. 154(b) by 541 days.

(21) Appl. No.: 12/027,599

(22) Filed: Feb. 7, 2008

(65) Prior Publication Data

US 2009/0200270 A1 Aug. 13, 2009

(51) Int. Cl.
*H01H 33/66* (2006.01)

(52) U.S. Cl. ..... 218/153; 218/7; 218/119

(58) Field of Classification Search ..... 218/7–14, 218/44, 118–120, 152–154
See application file for complete search history.

(56) References Cited

U.S. PATENT DOCUMENTS

| | | | | |
|---|---|---|---|---|
| 5,017,859 | A | 5/1991 | Engel et al. | |
| 5,912,604 | A | 6/1999 | Harvey et al. | |
| 6,362,445 | B1 * | 3/2002 | Marchand et al. | 218/155 |
| 6,414,257 | B1 * | 7/2002 | Luscan et al. | 218/118 |

* cited by examiner

*Primary Examiner* — Renee Luebke
*Assistant Examiner* — Marina Fishman
(74) *Attorney, Agent, or Firm* — Martin J. Moran

(57) ABSTRACT

A medium voltage circuit interrupter includes a circuit interrupter housing and a plurality of poles. Each of the poles includes an encapsulated pole unit. The encapsulated pole unit includes a first unit having a first conductor, a second conductor, a vacuum interrupter electrically connected between the first conductor and the second conductor, and a first housing housing the vacuum interrupter. A removable second unit includes a third conductor, a fourth conductor having a first portion electrically connected to the third conductor and a second portion removably electrically connected to one of the first conductor and the second conductor, an electronic device structured to sense a characteristic of the pole, and a second insulative housing encapsulating the third conductor, the first portion of the fourth conductor and the electronic device. An operating mechanism is structured to open and close the vacuum interrupter of each of the poles.

2 Claims, 8 Drawing Sheets

ENCAPSULATED POLE UNIT CONDUCTOR ASSEMBLY FOR AN ENCAPSULATED POLE UNIT AND MEDIUM VOLTAGE CIRCUIT INTERRUPTER INCLUDING THE SAME

BACKGROUND OF THE INVENTION

1. Field of the Invention

This invention pertains generally to circuit interrupters and, more particularly, to medium voltage circuit breakers including a plurality of poles. The invention also relates to pole units for circuit interrupters. The invention further relates to pole unit conductor assemblies for pole units.

2. Background Information

Circuit interrupters provide protection for electrical systems from electrical fault conditions such as, for example, current overloads and short circuits. Various circuit interrupters include a spring powered operating mechanism, which opens electrical contacts to interrupt the current through the conductors of an electrical system in response to abnormal conditions, although a wide range of mechanical, electromechanical or other suitable driving mechanisms may be employed.

Vacuum circuit interrupters (e.g., vacuum circuit breakers; vacuum reclosers; other vacuum switching devices) include separable contacts disposed within an insulating housing. Vacuum circuit interrupters, such as, for example, power circuit breakers for systems operating above about 1,000 volts, typically utilize vacuum switches (not to be confused with vacuum switching devices), such as vacuum interrupters (not to be confused with vacuum circuit interrupters), as the switch element.

U.S. Pat. No. 5,912,604 discloses a recloser including a housing to which is attached a number of pole assemblies. A separate pole assembly is provided for each pole. Each pole assembly generally includes three subassemblies, namely a molded pole assembly, a connecting assembly and an actuator assembly. Protruding from each pole assembly are connection studs. The poles are molded from polyurethane, polymer concrete, epoxy or EPDM (ethylene propylene diene methylene). During a molding or casting operation, a vacuum interrupter and studs are placed in a mold and held in place by securing the studs. Any sensors, such as a current sensor and a voltage sensor, are held in place using porous insulating material. The current and voltage sensors are concentric rings positioned around a portion of one stud. The porous material is placed between the concentric rings and the stud. The polyurethane encapsulating material in its liquid state fills all mold voids including those voids in the porous insulating material.

It is known to provide circuit breaker pole assembly bottom conductors in the form of copper bars (or tubes) with an epoxy insulator on the outside. However, such known bottom conductors do not include any current transformer (CT) or any electronic sensing circuit. Since known CTs for corresponding circuit breakers are relatively very large and relatively very heavy, they are not disposed at the circuit breaker. Furthermore, such CTs would likely fail during circuit breaker testing.

There is room for improvement in medium voltage circuit interrupters.

There is also room for improvement in pole units for circuit interrupters.

There is further room for improvement in pole unit conductor assemblies for circuit interrupter pole units.

SUMMARY OF THE INVENTION

These needs and others are met by embodiments of the invention, which provide a removable unit for an encapsulated pole unit of a pole of a circuit interrupter in which an insulative housing encapsulates a line or load conductor along with an electronic device structured to sense a characteristic of the pole.

In accordance with one aspect of the invention, a medium voltage circuit interrupter comprises: a circuit interrupter housing; a plurality of poles, each of the poles including a characteristic, each of the poles comprising an encapsulated pole unit comprising: a first unit comprising: a first conductor, a second conductor, a vacuum interrupter electrically connected between the first conductor and the second conductor, and a first housing housing the vacuum interrupter, and a removable second unit comprising: a third conductor, a fourth conductor including a first portion electrically connected to the third conductor and a second portion removably electrically connected to one of the first conductor and the second conductor, an electronic device structured to sense the characteristic, and a second insulative housing encapsulating the third conductor, the first portion of the fourth conductor and the electronic device; and an operating mechanism structured to open and close the vacuum interrupter of each of the poles.

The second conductor may be below the first conductor; and the second portion of the fourth conductor may be removably electrically connected to the second conductor.

The electronic device may be a voltage sensor comprising a capacitive voltage divider structured to sense the voltage.

In accordance with another aspect of the invention, an encapsulated pole unit includes a characteristic and comprises: a first unit comprising: a first conductor, a second conductor, a vacuum interrupter electrically connected between the first conductor and the second conductor, and a first housing housing the vacuum interrupter; and a removable second unit comprising: a third conductor, a fourth conductor including a first portion electrically connected to the third conductor and a second portion removably electrically connected to one of the first conductor and the second conductor, an electronic device structured to sense the characteristic, and a second insulative housing encapsulating the third conductor, the first portion of the fourth conductor and the electronic device.

The electronic device may be selected from the group consisting of a current sensor, a temperature sensor, a partial discharge sensor and a voltage sensor.

As another aspect of the invention, an encapsulated pole unit conductor assembly includes a characteristic and comprises: a first conductor; a second conductor electrically connected to the first conductor, the second conductor being structured to be removably electrically connected to a pole unit of a circuit interrupter; an electronic device structured to sense the characteristic; and an insulative housing encapsulating the first conductor and the electronic device, the insulative housing being structured to be mounted with respect to the circuit interrupter along with a number of other encapsulated pole unit conductor assemblies.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
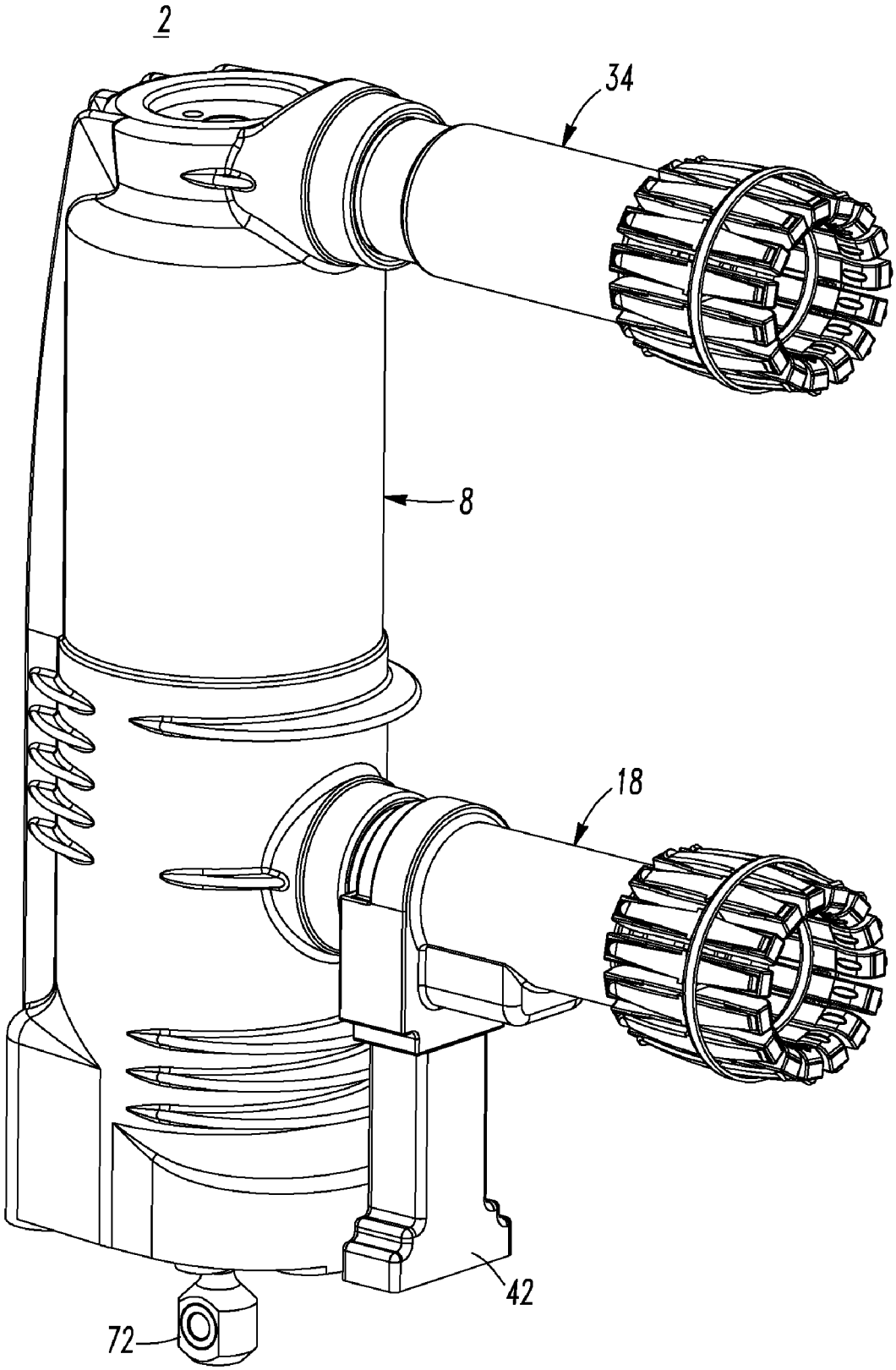
FIG. 1 is an isometric view of an encapsulated pole unit in accordance with embodiments of the invention.

Directional phrases used herein, such as, for example, left, right, upper, lower, above, below, clockwise, counterclockwise and derivatives thereof, relate to the orientation of the elements shown in the drawings and are not limiting upon the claims unless expressly recited therein.

As employed herein, the term "fastener" refers to any suitable connecting, tightening or fastening mechanism expressly including, but not limited to, screws, bolts and the combinations of bolts and nuts (e.g., without limitation, lock nuts) and bolts, washers and nuts.

As employed herein, the statement that two or more parts are "coupled" together means that the parts are joined together either directly or joined through one or more intermediate parts.

As employed herein, the term "number" means one or an integer greater than one (i.e., a plurality).

As employed herein, the term "encapsulated" means at least substantially surrounded by a number of insulative structures.

As employed herein, the term "encapsulating" means at least substantially surrounding a conductive structure by a number of insulative structures. For example, when a conductive structure is encapsulated by a number of insulative structures, the conductive structure is at least substantially embedded within such number of insulative structures.

As employed herein, the term "characteristic" means a trait, a quality, or a property of a structure that is capable of being sensed, such as, for example and without limitation, a voltage, a current or a temperature.

As employed herein, the term "sensed" means to perceive or detect by an electronic device, such as a sensor or detector.

As employed herein, the term "electronic device" include devices structured to sense a number of characteristics of a structure. Electronic devices include, for example and without limitation, voltage sensors, current sensors, partial discharge sensors and temperature sensors.

The invention is disclosed in association with a medium voltage vacuum circuit breaker having three independent poles, although the invention is applicable to a wide range of circuit interrupters (e.g., without limitation, reclosers, circuit switching devices and other interrupters, such as contactors, motor starters, motor controllers and other load controllers) including any suitable count of poles for a wide range of voltages.

Figure 2:
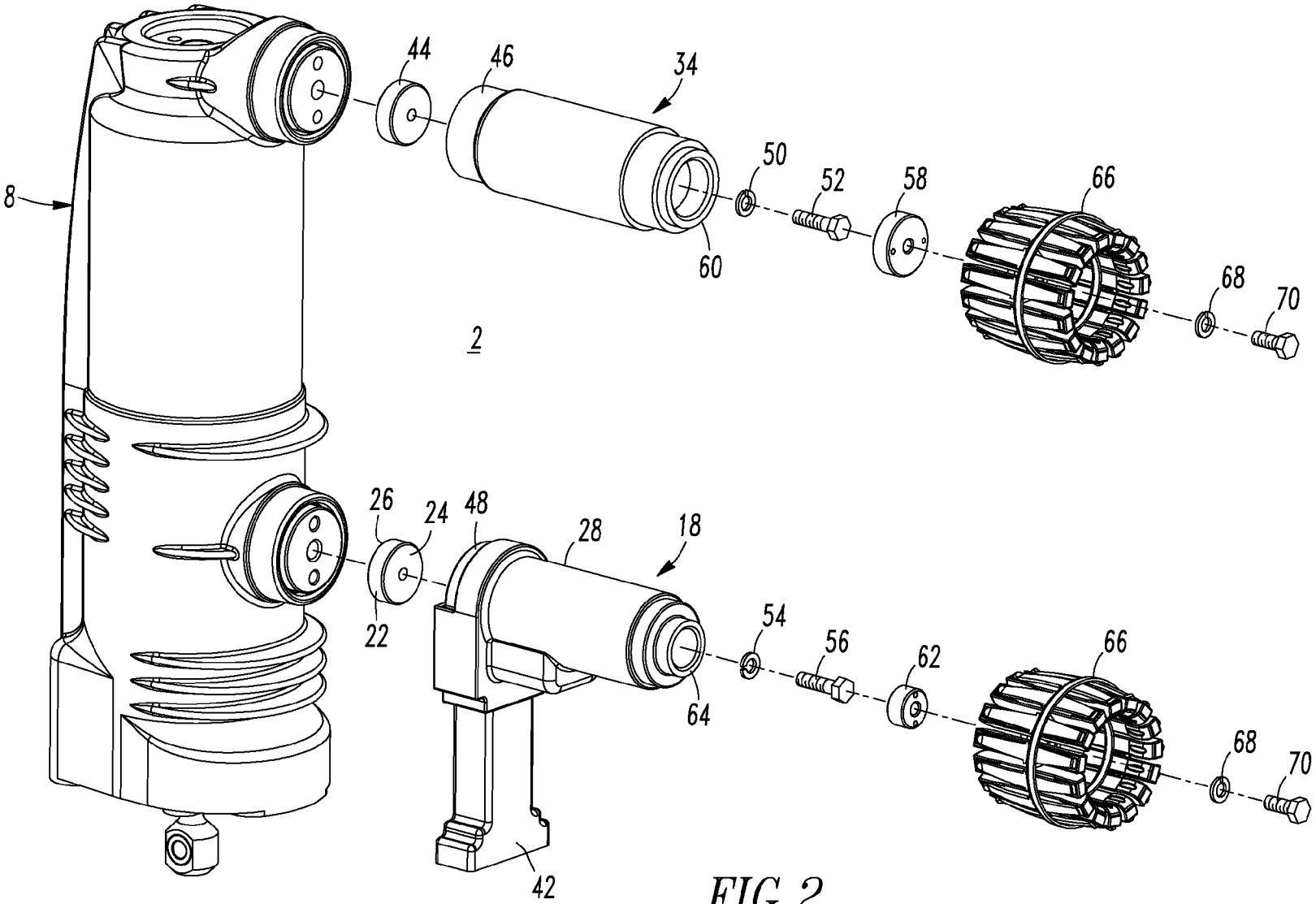
FIG. 2 is an exploded isometric view of the encapsulated pole unit of FIG. 1.
Figure 3:
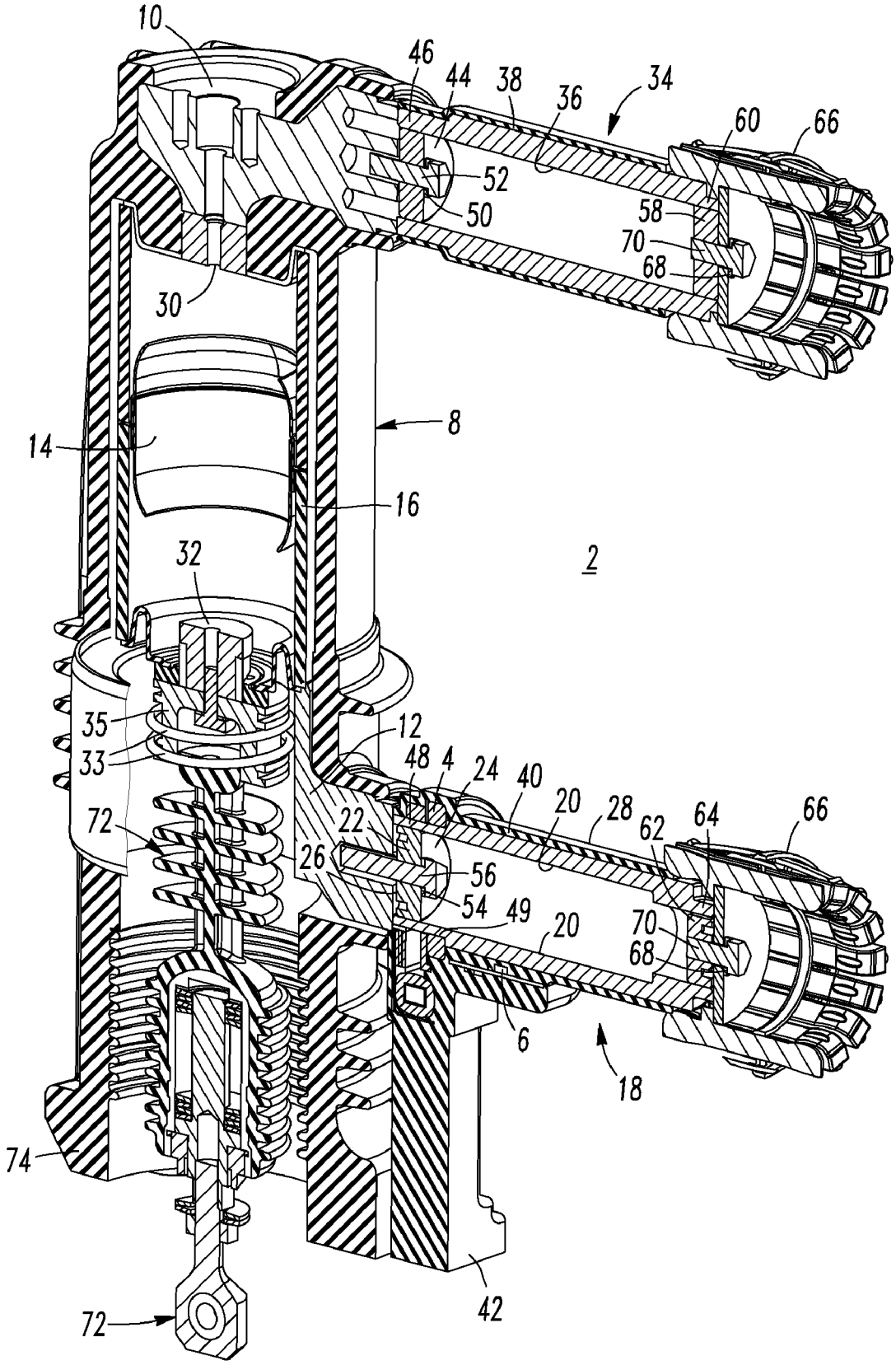
FIG. 3 is a partial cross-sectional view of the encapsulated pole unit of FIG. 1.

Referring to FIGS. 1-3, an encapsulated pole unit 2 includes a number of embedded sensors 4,6 (shown in FIG. 3), as will be discussed. The example sensors 4 and 6 are electronic devices structured to sense characteristics of a circuit interrupter pole corresponding to the encapsulated pole unit 2, such as, for example and without limitation, current and temperature, respectively. However, a wide range of electronic devices for other characteristics of circuit interrupter poles may be employed, such as for example and without limitation, partial discharge sensors and voltage sensors. The encapsulated pole unit 2 includes a first unit 8 including a first conductor 10, a second conductor 12, a vacuum interrupter 14 electrically connected between the first conductor 10 and the second conductor 12, and a first housing 16 housing the vacuum interrupter 14. The encapsulated pole unit 2 also includes a removable second unit 18 including a third conductor 20, a fourth conductor 22 including a first portion 24 electrically connected to the third conductor 20 and a second portion 26 removably electrically connected to one of the first and second conductors 10,12. The removable second unit 18 forms an encapsulated pole unit conductor assembly. Preferably, the first housing 16 is an insulative housing, such as an outer silicone sleeve, encapsulating the vacuum interrupter 14. Although the third and fourth conductors 20,22 are shown as separate distinct structures, it will be appreciated that the third and fourth conductors 20,22 may be parts of a single integrated structure.

In the example of FIGS. 1-3, the second portion 26 is removably electrically and mechanically connected to the second conductor 12, as will be explained. A second insulative housing 28 encapsulates the third conductor 20, the first portion 24 of the fourth conductor 22 and the example sensors 4,6. The second conductor 12 is below the first conductor 10 with respect to FIGS. 1-3. The vacuum interrupter 14 includes an upper conductor 30, which is electrically connected to the first conductor 10, and a lower conductor 32, which is electrically connected to the second conductor 12. The lower conductor 32, which is the movable contact of the separable contacts 180 (FIG. 8), is preferably electrically connected to the second conductor 12 by a pair of conductive spring contacts 33. A conductive spring housing 35 carries the lower conductor 32 and the spring contacts 33 and is movably coupled to the drive rod assembly 72.

Although two example embedded sensors 4,6 are shown, one, three or more embedded sensors may be employed. The example encapsulated pole unit 2 also includes a removable top conductor assembly 34 in addition to the removable second unit 18, which is a removable bottom conductor assembly having the example embedded sensors 4,6. The removable top conductor assembly 34 includes a conductor in the form of a conductive conduit 36 encapsulated with an insulative layer, such as an epoxy layer 38 (FIG. 3). Similarly, the removable bottom conductor assembly 18 includes the third conductor 20 in the form of a conductive conduit encapsulated with an insulative layer, such as an epoxy layer 40 (FIG. 3). The removable bottom conductor assembly 18 also includes a section formed as an epoxy mold 42.

As shown in FIGS. 2 and 3, a first threaded plug, such as conductive disk 44, is threaded into a first end 46 of the conductive conduit 36 (FIG. 3). Similarly, the fourth conductor 22 is threaded plug, such as a conductive disk, threaded into a first end 48 of the conductive conduit 20 (FIG. 3). A suitable fastener, such as a lock washer 50 and a bolt 52, removably couple the conductive conduit 36 through the conductive disk 44 to the first conductor 10, which is the fixed top conductor of the pole unit 2. In a similar manner, a suitable fastener, such as a lock washer 54 and a bolt 56, removably couple the conductive conduit 20 through the fourth conductor 22 to the second conductor 12, which is the fixed bottom conductor of the pole unit 2. A third threaded plug, such as conductive disk 58, is threaded into the opposite second end 60 of the conductive conduit 36 (FIG. 3), and a fourth threaded plug, such as conductive disk 62, is threaded into the opposite second end 64 of the conductive conduit 20. Then, two finger cluster assemblies 66 are coupled to the conductive disks 58,62 with suitable fasteners, such as lock washers 68 and bolts 70. As is conventional, the vacuum interrupter 14 is driven by a drive rod assembly 72. The first unit 8 also includes an insulative section formed as an epoxy mold 74.

In the example of FIGS. 1-3, an embedded air core coil, such as the example Rogowski coil 4, and an embedded temperature sensor 6 are mounted within the removable bottom conductor assembly 18 of the encapsulated pole unit 2. The Rogowski coil 4 is a current sensor. Alternatively, the embedded air core coil may be a current transformer. Alternating current (AC) current flows through the conductive conduits 36,20 at the respective top and bottom of the encapsulated pole unit 2. Preferably, the example Rogowski coil 4 is separated from the conductive conduit 20 with about 0.25 inch to about 0.50 inch of a suitable epoxy insulator. One difference between the upper and lower removable conductor assemblies 34,18 is that the removable bottom conductor assembly 18 includes the embedded sensors 4,6. Hence, if something were to go wrong with any one or more of those sensors 4,6, then the removable bottom conductor assembly 18 could be readily replaced instead of replacing the entire encapsulated pole unit 2, which would be relatively more costly.

The following discussion assumes that a load terminal and the corresponding load voltage are provided at the lower finger cluster assembly 66 (FIGS. 1-3) and that the corresponding line voltage is present at the upper finger cluster assembly 66 (FIGS. 1-3). It will, however, be appreciated that these example voltages may be reversed. In this example, the AC current is the current at load side, and the example Rogowski coil 4 is structured to sense the current at load side. If the voltages are reversed, then the Rogowski coil 4 senses the current at line side and the conductive conduit 20 is a line conductor. The conductive conduit 20 is a generally cylindrical conductor including the end portion 48. The Rogowski coil 4 includes a generally circular opening 49 disposed about the generally cylindrical conductive conduit 20 proximate the end portion 48 thereof. The fourth conductor 22 is disposed from that end portion 48.

The example temperature sensor 6 is structured to sense the temperature of the adjacent conductive conduit 20, which is a load conductor in this example. For example, the conductive conduit 20 is a generally cylindrical conductor including an elongated generally cylindrical surface. The temperature sensor 6 is disposed proximate that elongated generally cylindrical surface as shown in FIG. 3.

Preferably, the external insulation 38,40,42,74 of the encapsulated pole unit 2 is a suitable epoxy that supports all the internal components thereof (e.g., the epoxy is molded around them). The encapsulated pole unit 2 is insulated in order to avoid a voltage breakdown issue (e.g., a Lightning Impulse Withstand Voltage (LIWV) or Basic Impulse Level (BIL) test requirement). Shielded internal electrical connections enable characteristic sensing, such as current and voltage sensing, as will be discussed below in connection with FIGS. 4-7.

FIGS. 4 and 5, 6, and 7 show examples of other removable bottom conductor assemblies 76, 78, and 80, in which the voltage sensor is a capacitive voltage divider 82, 84, and 86, respectively, structured to sense the line or load voltage. These example voltage dividers employ two capacitors to divide the relatively high line or load voltage and output a relatively much lower output voltage. For example, the line or load voltage at the vacuum interrupter 14 (FIG. 3) is provided to the corresponding one of the voltage dividers 82,84,86. Except for these voltage sensors 82,84,86, the removable bottom conductor assemblies 76,78,80 are the same as or similar to the removable bottom conductor assembly 18 of FIGS. 1-3. Hence, it will be appreciated that the example removable bottom conductor assemblies 76,78,80 are usable with the first unit 8 of FIGS. 1-3.

The following discussion assumes that a line terminal and the corresponding line voltage are provided at the lower finger cluster assembly 66 (FIGS. 1-3) and that the corresponding load voltage is present at the upper finger cluster assembly 66 (FIGS. 1-3). It will, however, be appreciated that these example voltages may be reversed.

Figure 4:
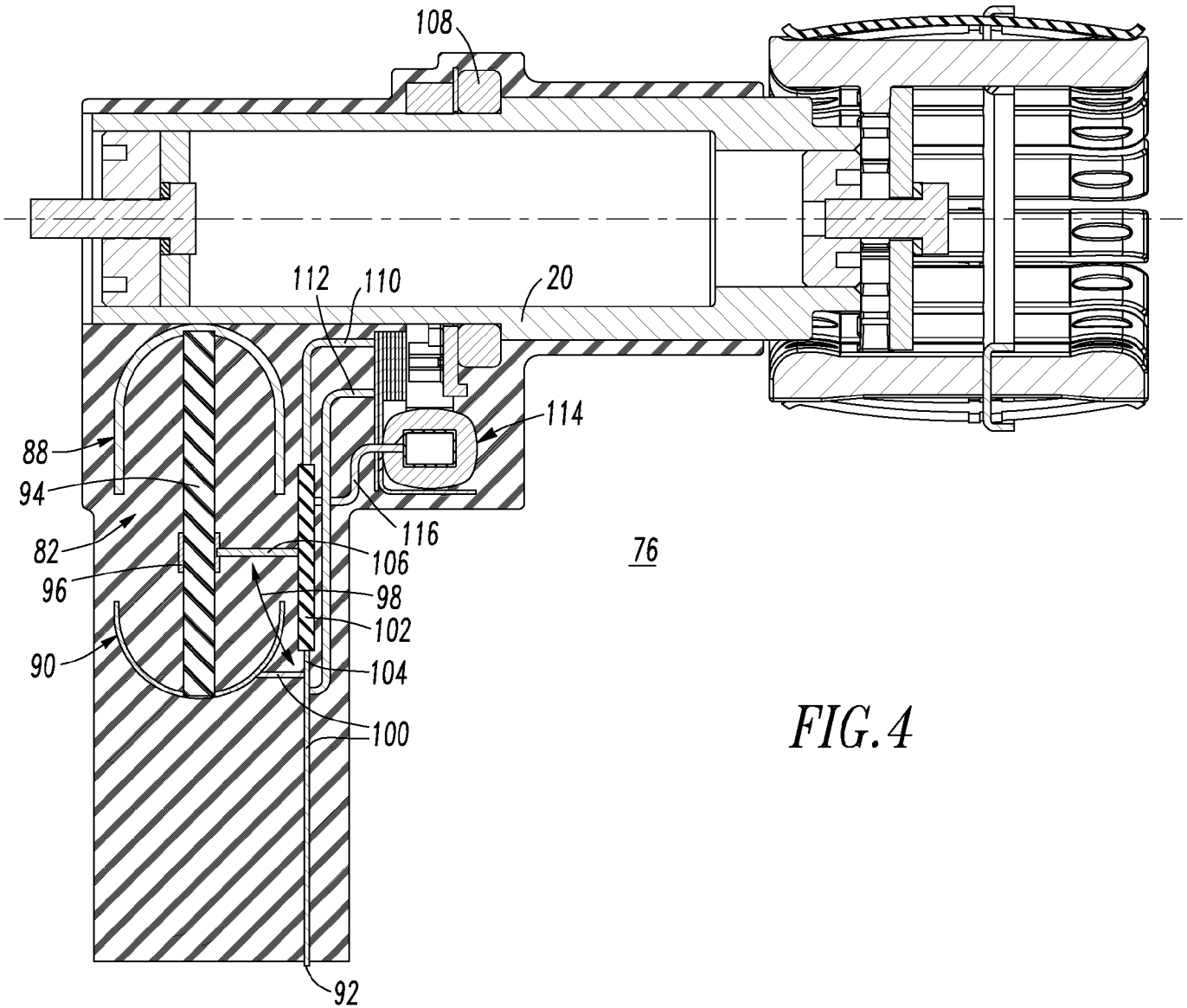
FIG. 4 is a cross-sectional view of a removable bottom conductor assembly for an encapsulated pole unit in accordance with another embodiment of the invention.
Figure 5:
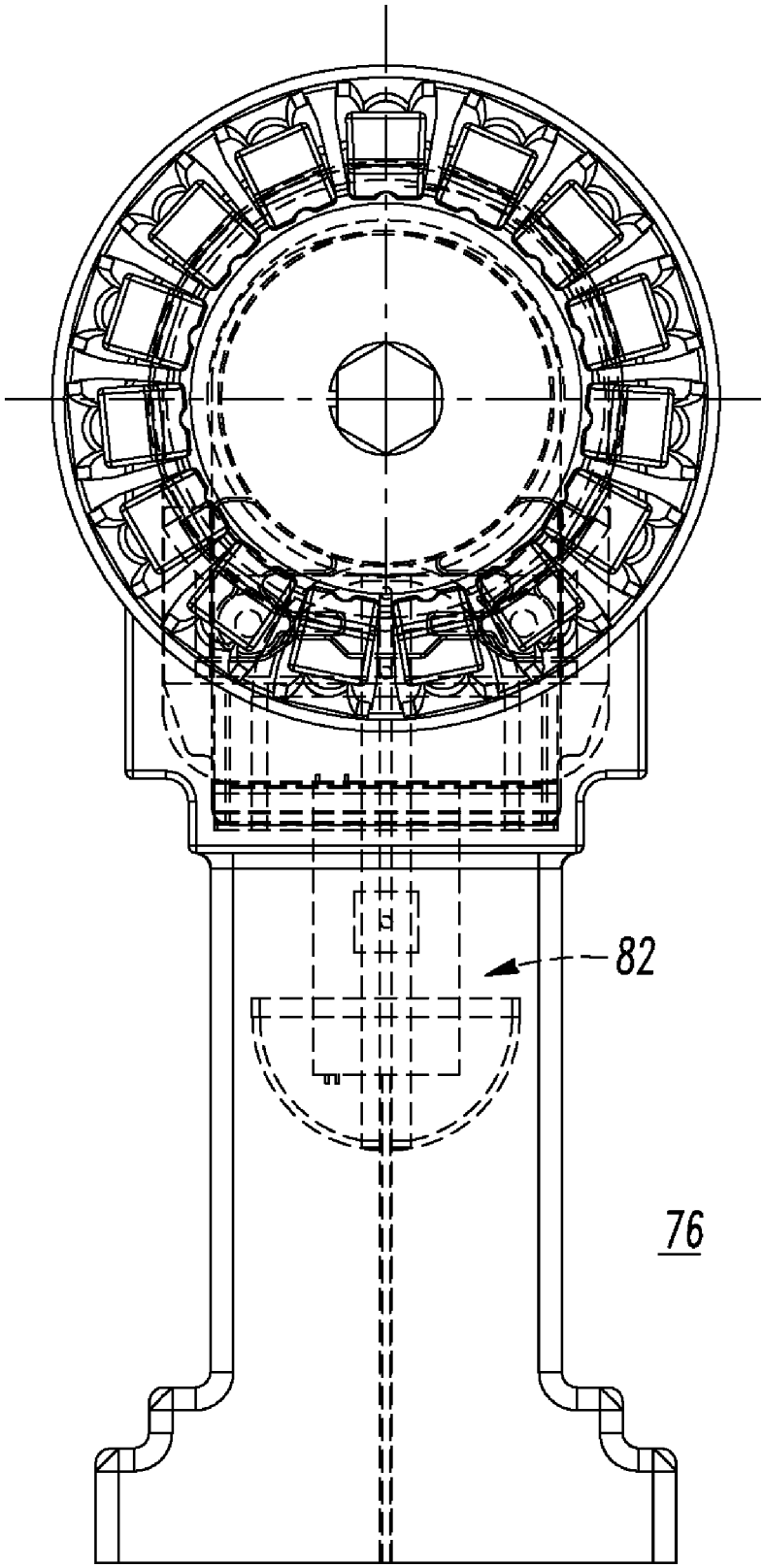
FIG. 5 is a vertical end elevation view of the removable bottom conductor assembly of FIG. 4.

FIGS. 4 and 5 show the example voltage divider voltage sensor 82, which is in the form of a double cup assembly. The voltage sensor 82 includes a first bell-shaped conductive member 88 electrically connected to the second conductor 20, a second bell-shaped conductive member 90 electrically connected to ground 92, an elongated insulative member 94 disposed between the first and second bell-shaped conductive members 88,90, and a conductive ring 96 disposed about the elongated insulative member 94 and between the first and second bell-shaped conductive members 88,90. The conductive ring 96 and the second bell-shaped conductive member 90 output a second voltage 98, which is substantially smaller than the voltage between the second conductor 20 and ground 92.

Although the voltage sensor 82 is described, above, as being suitable for sensing a line or load voltage, it will be appreciated that the voltage sensor 82 is also suitable for sensing a partial discharge of the second conductor 20. For example, when a partial discharge is occurring, the line-to-load voltage drops to the discharge voltage, which usually is about a few hundred volts to about a thousand volts, and is much lower than the line voltage. Partial discharge voltage values are sensed from voltage differences between the line or load voltage and ground 92. A printed circuit board (PCB) 102 senses the voltage differences by using the example voltage sensor 82. The voltage sensor 82 includes the two bell-shaped conductive members 88,90, which have electrical potentials of the line or load voltage and ground, respectively. The upper bell-shaped conductive member 88 is preferably directly electrically connected to the adjacent second conductor 20. The lower bell-shaped conductive member 90 is electrically connected to ground 92 by a number of ground conductors 100. The capacitive voltage divider 82, is formed by the example rod 94, which is disposed between the two bell shaped conductive members 88,90. The rod 94 is an insulator with a conductive coated ring or solid conductive ring 96 disposed on it and somewhat closer to the lower bell-shaped conductive member 90, in order to form the capacitive voltage divider 82. The PCB 102 includes a first electrical connection 104 to ground 92 and a second electrical connection 106, which forms the tap of the capacitive voltage divider 82. The upper bell shaped conductive member 88 and the conductive ring 96 form a first capacitor. The lower bell shaped conductive member 90 and the conductive ring 96 form a second capacitor that outputs the voltage 98, which is proportional to the line voltage, but significantly smaller. Alternatively, the conductive ring 96 can be a conductive plate (not shown).

The example removable bottom conductor assembly 76 further includes a Rogowski coil assembly 108 having an output 110 to the PCB 102, which is referenced to ground 92 by the conductor 112, and a parasitic power supply 114 having an output 116 to the PCB 102.

Figure 6:
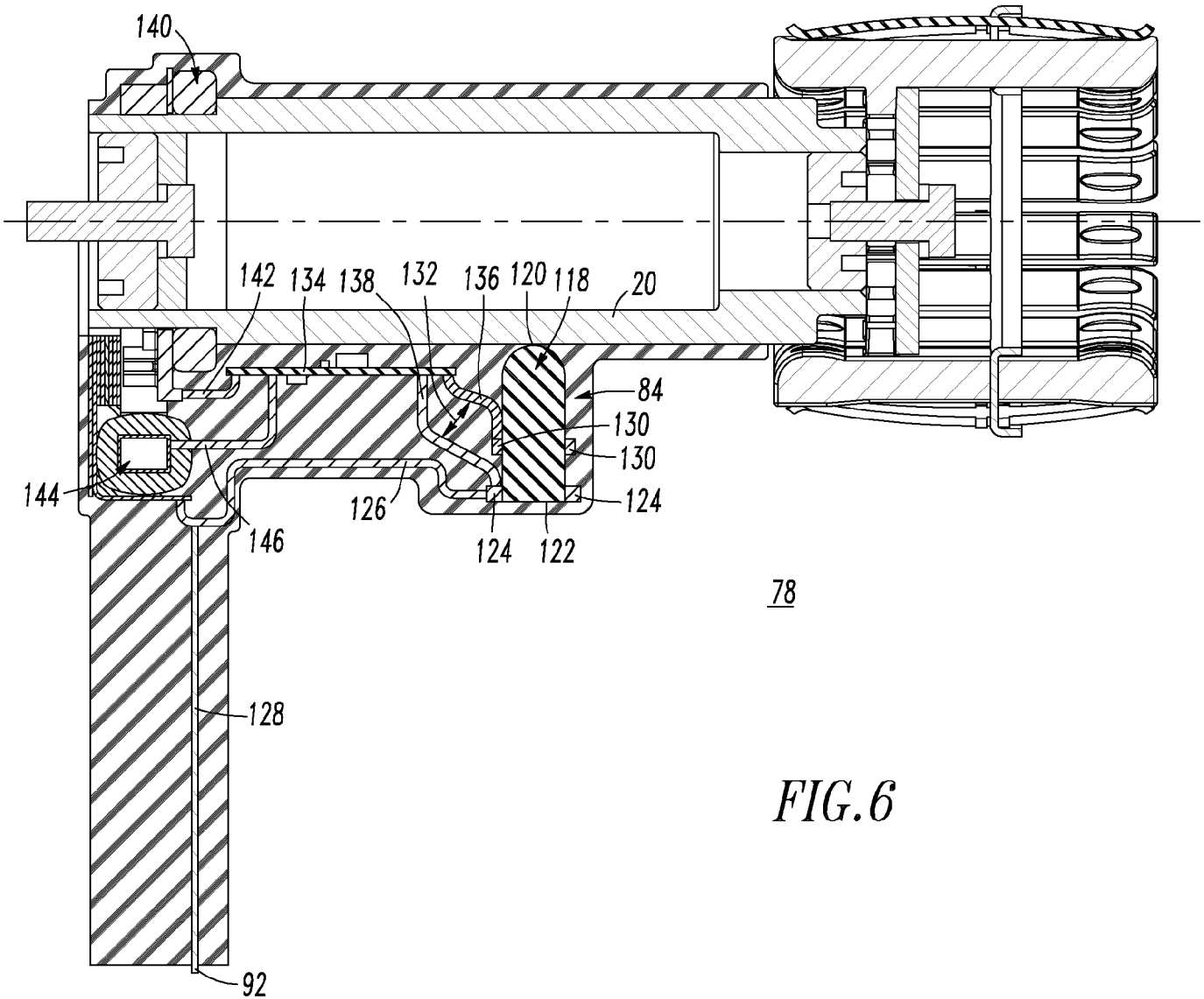
FIGS. 6 and 7 are cross-sectional views of removable bottom conductor assemblies for encapsulated pole units in accordance with other embodiments of the invention.

FIG. 6 shows the voltage sensor 84 in the example form of a double plate assembly. The capacitive voltage divider 84 includes an elongated insulative member 118 having a first end 120 engaging the second conductor 20 and an opposite second end 122. A first conductive ring member 124 is disposed about the elongated insulative member 118 and is electrically connected to ground 92 by a number of conductors 126,128. A second conductive ring member 130 is disposed about the elongated insulative member 118 and is apart from and between the first end 120 thereof and the first conductive ring member 124. The first and second conductive ring members 124,130 output a voltage 132, which is substantially smaller than the line voltage between the second conductor 20 and ground 92. These example conductive ring members 124,130, which may alternatively be conductive plates (not shown), along with the elongated insulative member 118 form the capacitive voltage divider 84. The voltage 132 is input by the PCB 134 through conductors 136,138. The PCB 134, thus, receives both the voltage sensor output and ground 92 through the conductors 136,138.

The example removable bottom conductor assembly 78 further includes a Rogowski coil assembly 140 having an output 142, and a parasitic power supply 144 having an output 146. Both of the outputs 142,146 are received by the PCB 134.

Figure 7:
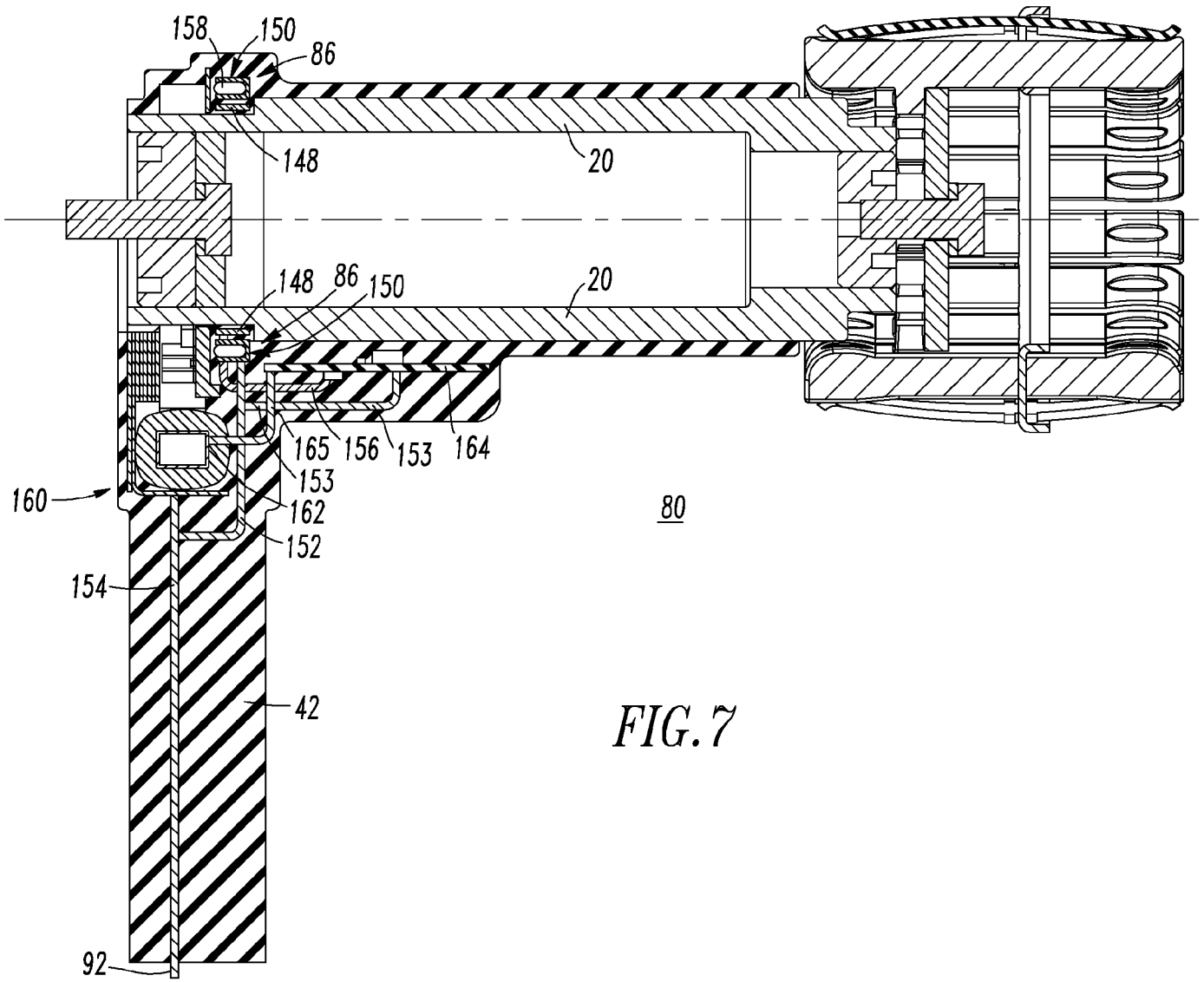

FIG. 7 shows the voltage sensor 86 in the example form of an integrated current and voltage sensing assembly. The capacitive voltage divider 86 includes a first conductive ring-shaped member 148 surrounding and spaced apart from the generally cylindrical second conductor 20, and a second conductive ring-shaped member 150 surrounding and spaced apart from the first conductive ring-shaped member 148. The second conductive ring-shaped member 150 is electrically connected to ground 92 by a number of conductors 152,154. The example first and second conductive ring-shaped members 148,150 are at least generally concentric and output a voltage, with respect to ground 92, which voltage is substantially smaller than the line voltage.

The example second conductive ring-shaped member 150 has an example generally U-shaped cross-section. A current sensor, such as a coil 158, surrounding and spaced apart from the second conductor 20 is disposed within the generally U-shaped cross-section. The example coil 158 is preferably a Rogowski coil. The Rogowski coil 158 and the capacitive voltage divider 86 cooperate to form an integrated voltage and current sensor. A parasitic power supply 160 includes an output 162. A PCB 164 receives the output 162 and the voltage through the conductors 165 and 156, respectively. The PCB 164 receives the ground 92 through conductors 154,152,153.

For each of the capacitive voltage dividers 82,84,86 of FIGS. 4-7, Equation 1, below, provides the secondary voltage output, $V_{OUTPUT}$.

$$V_{OUTPUT}=V_{LINE}*C1/(C1+C2) \quad \text{(Eq. 1)}$$

wherein:

$V_{LINE}$ is the line or load voltage;

C1 is the capacitance of the first capacitor; and

C2 is the capacitance of the second capacitor.

Figure 8:
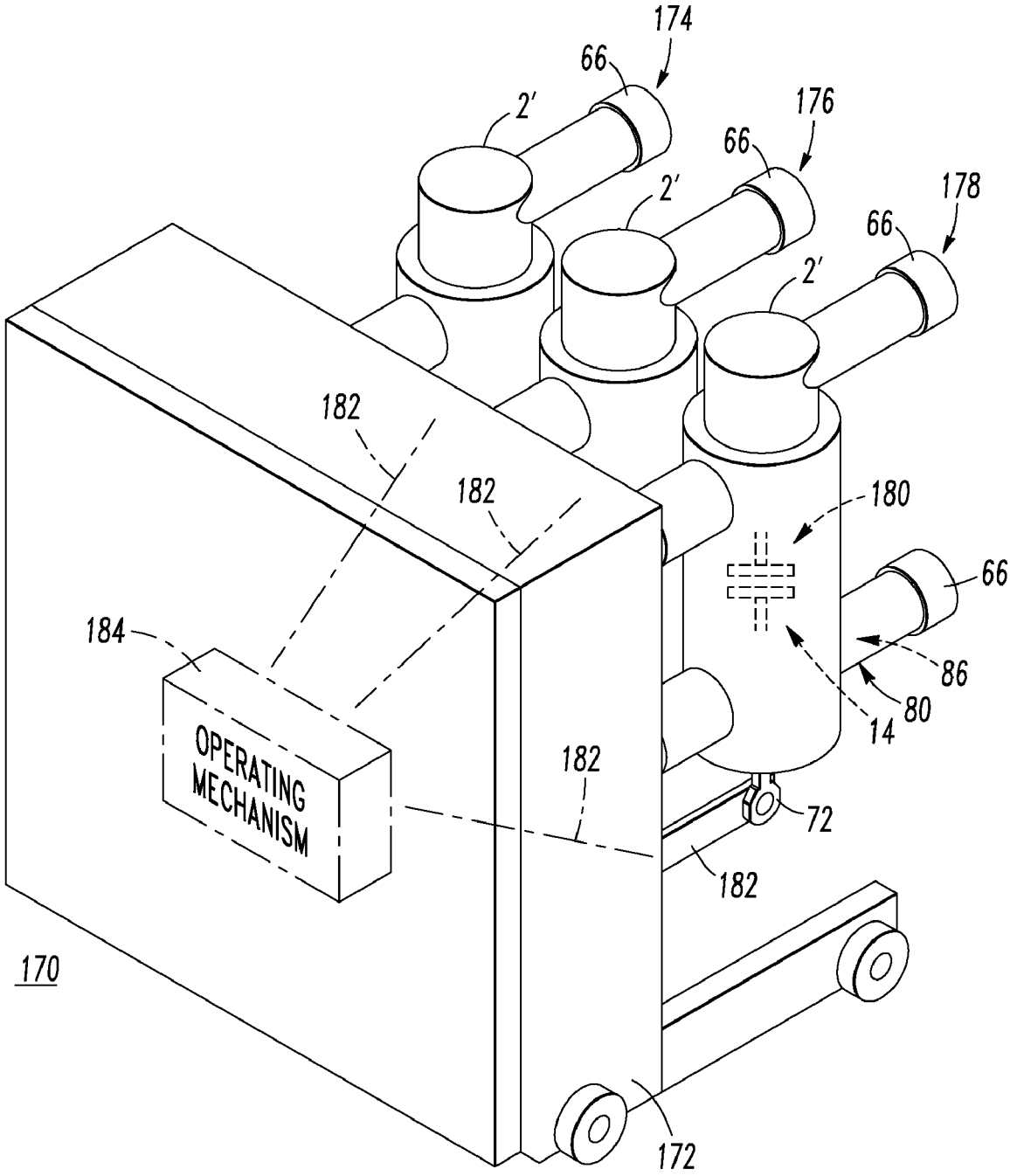
FIG. 8 is an isometric view of a three-pole circuit breaker in accordance with another embodiment of the invention.

Referring to FIG. 8, a circuit interrupter, such as a medium voltage vacuum circuit breaker 170, includes a circuit interrupter housing 172 and three independent poles 174,176,178. Each of the independent poles 174,176,178 includes separable contacts 180 (shown in hidden line drawing with pole 178), a number of sensors (e.g., a corresponding one of the example capacitive voltage divider 86 of FIG. 7, which includes the Rogowski coil 158), and a linkage 182 to the drive rod assembly 72 (FIG. 3). The medium voltage vacuum circuit breaker 170 also includes an operating mechanism 184 structured to open and close the vacuum interrupter 14 (FIG. 3) of each of the poles 174,176,178 through the linkages 182 and drive rod assemblies 72.

For each of the poles 174,176,178, the circuit breaker 170 includes an encapsulated pole unit 2', which is similar to the encapsulated pole unit 2 (FIGS. 1-3) except that the removable bottom conductor assembly 80 of FIG. 7 is employed in this example. Alternatively, any of the removable bottom conductor assemblies 18, 76 and 78 of FIGS. 1-3, 4 and 5, and 6, respectively, can be employed. The example removable bottom conductor assembly 80 forms an encapsulated pole unit conductor assembly. The example section 42 (FIGS. 1-3) formed as an epoxy mold encapsulates the conductor 20, the example capacitive voltage divider 86 and the example Rogowski coil 158 of FIG. 7. The resulting insulative housing is, thus, mounted with respect to the circuit interrupter 170 along with two additional encapsulated pole units 2' having corresponding removable bottom conductor assemblies 80 (as shown with pole 178).

Although the capacitive voltage divider 86 of FIG. 7 is shown as an example sensor, any suitable sensor may be employed for sensing a number of the characteristics of a pole of the example medium voltage vacuum circuit breaker 170. For example and without limitation, the encapsulated pole unit 2 of FIGS. 1-3 may be employed with the removable bottom conductor assembly 18 thereof, or with the removable bottom conductor assemblies 76 (FIGS. 4 and 5) or 78 (FIG. 6).

The disclosed encapsulated pole unit 2' permits the example medium voltage circuit interrupter 170 to be relatively small compared to known circuit interrupters.

The disclosed removable bottom conductor assembly 18 encapsulates the various sensors. In known circuit interrupters, such sensors are in the switchgear, which causes the overall assembly to be much larger. Also, this enables the encapsulated pole unit 2 or 2' to be certified as a complete tested assembly. This eliminates further extensive testing by a supplier because the complete assembly is pre-tested versus separate sub-assemblies being tested separately.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A medium voltage circuit interrupter comprising:

a circuit interrupter housing;

a plurality of poles, each of said poles including a characteristic, each of said poles comprising an encapsulated pole unit comprising:

a first unit comprising:

a first conductor, a second conductor, a vacuum interrupter electrically connected between said first conductor and said second conductor, and a first housing housing said vacuum interrupter, and a removable second unit comprising:

a third conductor, a fourth conductor including a first portion electrically connected to said third conductor and a second portion removably electrically connected to one of said first conductor and said second conductor, an electronic device structured to sense said characteristic, and a second insulative housing encapsulating said third conductor, the first portion of said fourth conductor and said electronic device; and an operating mechanism structured to open and close the vacuum interrupter of each of said poles;

wherein said characteristic comprises a voltage of said second conductor; and wherein said electronic device is structured to sense said voltage;

wherein said electronic device is a voltage sensor comprising a capacitive voltage divider structured to sense said voltage; and wherein said voltage is a first voltage; wherein said capacitive voltage divider comprises a first bell-shaped conductive member electrically connected to said second conductor, a second bell-shaped conductive member electrically connected to ground, an elongated insulative member disposed between said first and second bell-shaped conductive members, and a conductive ring disposed about said elongated insulative member and between said first and second bell-shaped conductive members, said conductive ring and said second bell-shaped conductive member outputting a second voltage which is substantially smaller than said first voltage.

2. A medium voltage circuit interrupter comprising:

a circuit housing;

a plurality of poles, each of said poles including a characteristic, each of said poles comprising an encapsulated pole unit comprising:

a first unit comprising:

a first conductor, a second conductor, a vacuum interrupter electrically connected between said first conductor and said second conductor, and a first housing housing said vacuum interrupter, and a removable second unit comprising:

a third conductor, a fourth conductor including a first portion electrically connected to said third conductor and a second portion removably electrically connected to one of said first conductor and said second conductor, an electronic device structured to sense said characteristic, and a second insulative housing encapsulating said third conductor, the first portion of said fourth conductor and said electronic device; and an operating mechanism structured to open and close the vacuum interrupter of each of said poles;

wherein said characteristic is partial discharge of said second conductor; and wherein said electronic device is structured to sense said partial discharge; and wherein said electronic device is a voltage sensor comprising a capacitive voltage divider structured to sense said voltage; wherein said voltage is a first voltage; wherein said capacitive voltage divider comprises a first bell-shaped conductive member electrically connected to said second conductor, a second bell-shaped conductive member electrically connected to ground, an elongated insulative member disposed between said first and second bell-shaped conductive members, and a conductive ring disposed about said elongated insulative member and between said first and second bell-shaped conductive members, said conductive ring and said second bell-shaped conductive member outputting a second voltage which is substantially smaller than said first voltage.

* * * * *